US006186280B1

(12) United States Patent
Healy

(10) Patent No.: US 6,186,280 B1
(45) Date of Patent: Feb. 13, 2001

(54) LIFT SAFETY SYSTEM

(75) Inventor: Donald A. Healy, Conway, AR (US)

(73) Assignee: Snap-On Technologies, Inc., Lincolnshire, IL (US)

( * ) Notice: Under 35 U.S.C. 154(b), the term of this patent shall be extended for 0 days.

(21) Appl. No.: 09/395,942

(22) Filed: Sep. 14, 1999

(51) Int. Cl.[7] ..... B66F 7/00; B66F 7/20

(52) U.S. Cl. ..... 187/207; 187/209; 187/390

(58) Field of Search ..... 187/203, 207, 187/208, 209, 210, 213, 390, 216

(56) References Cited

U.S. PATENT DOCUMENTS

| | | | | |
|---|---|---|---|---|
| 2,238,573 | * | 4/1941 | Steedman | 187/208 |
| 3,985,207 | * | 10/1976 | Petit | 187/208 |
| 4,134,501 | * | 1/1979 | Tune | 187/221 |
| 4,225,117 | * | 9/1980 | Suzuki | 187/209 |
| 4,247,922 | * | 1/1981 | Jackson et al. | 367/6 |
| 4,585,092 | * | 4/1986 | Dossier | 187/216 |
| 4,706,458 | * | 11/1987 | Corght | 187/209 |
| 5,012,898 | * | 5/1991 | Tsynberov | 187/210 |
| 5,052,883 | * | 10/1991 | Morita et al. | 414/700 |
| 5,082,085 | * | 1/1992 | Ream et al. | 182/2 |
| 5,285,020 | * | 2/1994 | Jurca | 177/139 |
| 5,299,658 | * | 4/1994 | Cox et al. | 187/213 |
| 5,508,597 | * | 4/1996 | Parmley, Sr. | 320/2 |
| 6,043,741 | * | 3/2000 | Whitmarsh | 340/540 |

FOREIGN PATENT DOCUMENTS

| | | | | |
|---|---|---|---|---|
| 402100999 | * | 4/1990 | (JP) | 187/207 |
| 404303400 | * | 10/1992 | (JP) | 187/208 |

* cited by examiner

*Primary Examiner*—Dean J. Kramer
*Assistant Examiner*—Paul T. Chin
(74) *Attorney, Agent, or Firm*—McDermott, Will & Emery

(57) ABSTRACT

A vehicle lift assembly prevents accidental slippage of a vehicle therefrom. The vehicle lift assembly comprises a plurality of vertically disposed posts and a runway slidably coupled to the plurality of vertical posts. A hoist system supplies the force necessary for elevating the runway along the plurality of posts. A sensor arrangement detects whether the runway has tilted beyond a predetermined angular displacement. A lift control circuit controls the hoist system to elevate the runway selectively in a prescribed direction, and suspends operation of the hoist system, when necessary, to prevent the vehicle from accidentally sliding off the runway.

13 Claims, 3 Drawing Sheets

LIFT SAFETY SYSTEM

BACKGROUND OF THE INVENTION

1. Field of the Invention

The present invention relates to lift assemblies for raising and lowering a vehicle, and, more particularly, to a safety system for use with a multi-post lift assembly used to raise and lower a vehicle.

2. Description of the Related Art

Lift assemblies are well known in the art, particularly in the automotive servicing field, where a technician must often raise an automobile to a predetermined height above the ground in order to make appropriate repairs. Automotive lift assemblies can be constructed in a variety of configurations. For example, one type of lift assembly incorporates a centrally disposed hydraulic shaft that includes a plurality of arms. The arms are extendable to support the vehicle at prescribed load bearing positions. Single post systems, however, have a disadvantage of requiring an underground tunnel within which the hydraulic post can be fully retracted to allow the vehicle to be placed in position for lifting. Such an arrangement is complicated to construct and has an additional disadvantage of being permanently fixed the location constructed.

Other vehicle lift assemblies incorporate multiple posts that are positioned at predetermined locations for raising and lowering the vehicle. For example, one such lift arrangement incorporates two posts, one on either side of the vehicle. Each post includes arms that can be extended to support the vehicle at the load bearing positions. Another system incorporates four posts located at predetermined positions that define a rectangular area. A platform assembly is attached to the four posts and functions to support the vehicle during lifting and lowering operations. Lift assemblies that incorporate multiple posts typically include a lifting mechanism coupled to each post. The lifting mechanism can be mechanical, or hydraulic in nature. For example, a screw type or hydraulic piston arrangement can be provided to apply an appropriate force and allow the posts to raise and lower the vehicle in unison. Each post can be provided with a manual lock that prevents inadvertent movement of the vehicle, or the lift assembly, while the technician services the vehicle.

During normal operations, it is imperative that the lifting mechanism of each post operate in a synchronous manner. Any deviation in the operation of one post will result in the vehicle being tilted in an unsafe manner. This situation will often place the vehicle in an unsafe or unstable orientation wherein the vehicle can be damaged and/or the technician can be injured. In general, the greater the number of posts that are used in the vehicle lift assembly, the greater the probability that one of the lifting mechanisms will malfunction, hence causing the lift assembly to tilt to an unsafe orientation.

There are several conditions that can result in a lift assembly being tilted to an unsafe orientation. One of the most common conditions occurs when a technician inadvertently forgets to disengage the manual lock at one of the posts. If the lift platform is either raised or lowered, the post (or posts) that was left locked will be unable to move, while the remaining posts will be free to move in the selected direction. Hence, the lift platform will be tilted such that the vehicle will occupy a dangerous orientation. If the technician does not detect the malfunction, the lift platform will continue to tilt until the vehicle falls off or the maximum travel distance of the posts have been reached. Further, such a condition can result in damage to the lift assembly.

Accordingly, one disadvantage of current multi-post lift assemblies is the inability to detect when the lift platform has tilted to an unsafe orientation. Another disadvantage associated with current multi-post lift assemblies is the inability to automatically suspend operation of the lift mechanism when the lift platform has tilted to an unsafe orientation.

DISCLOSURE OF THE INVENTION

There exists a need for a lift assembly capable of detecting when a lift platform has tilted to an unsafe orientation, and interrupting operation of the lifting mechanism. This and other needs are addressed by the present invention wherein a safety system for a lift assembly detects when a lift platform has tilted to an unsafe orientation and interrupts operation of the lifting mechanism, thereby providing a technician an opportunity to correct the problem.

In accordance with one aspect of the invention, a vehicle lift assembly is provided for preventing accidental slippage of a vehicle therefrom. The vehicle lift assembly comprises a plurality of vertically disposed posts, a runway, a hoist system, and a sensor arrangement. The runway is slidably coupled to the plurality of vertical posts, and configured to receive the vehicle thereon. The hoist system supplies the force necessary for elevating the runway along the plurality of posts. The sensor arrangement is used to detect whether the runway has tilted beyond a predetermined angular displacement. Furthermore, the sensor arrangement provides an indication of the orientation of the runway. A lift control circuit controls the hoist system to selectively elevate the runway in a prescribed direction. The lift control circuit also receives the tilt warning signal from the sensor arrangement. Upon receiving the tilt warning signal, the lift control circuit suspends operation of the hoist system in order to prevent the vehicle from sliding off the runway.

In accordance with another aspect of the present invention, a safety system is provided for use with a vehicle lift assembly having: a plurality of vertically disposed posts, a runway slidably coupled to the plurality of vertical posts for receiving the vehicle thereon, and a hoist system for elevating the runway relative to the plurality of posts. The safety system comprises a sensor arrangement and a lift control circuit. The sensor arrangement is used for detecting whether the runway has tilted beyond a predetermined angular displacement, and providing an indication of the orientation of the runway. The lift control circuit receives the tilt warning signal, and controls the hoist system to selectively elevate the runway in a prescribed direction. Further, upon receiving the tilt warning signal, the lift control circuit interrupts operation of the hoist system to prevent the vehicle from inadvertently sliding off the runway.

The present invention advantageously provides the ability to automatically suspend operation of the lift assembly if the sensor arrangement detects that the runway has tilted to an unsafe orientation. Hence, potential damage to the vehicle, or harm to the technician, as a result of the vehicle sliding off the runway can be minimized. Once operation of the runway has been suspended, the technician can examine the lift assembly to determine the cause of the malfunction. The lift assembly of the present invention can further include an alarm system to alert the technician when the tilt warning signal has been output by the sensor arrangement. The alarm system can be configured to provide visual and audible signals. Additionally, the hoist system can be hydraulically or mechanically driven depending on the specific implementation. Further, the safety system of the present invention can be adapted to work with various types of existing lift assemblies.

Additional advantages and novel features of the present invention will be set forth in part in the description which follows, and in part will become apparent to those skilled in the art upon examination of the following, or may be learned by practice of the invention. The advantages of the invention may be realized and attained by means of the instrumentalities and combinations particularly pointed out in the appended claims.

BRIEF DESCRIPTION OF THE DRAWINGS

Reference is made to the attached drawings, wherein elements having the same reference numeral designations represent like elements throughout and wherein.

DETAILED DESCRIPTION OF ILLUSTRATIVE EMBODIMENTS

Figure 1:
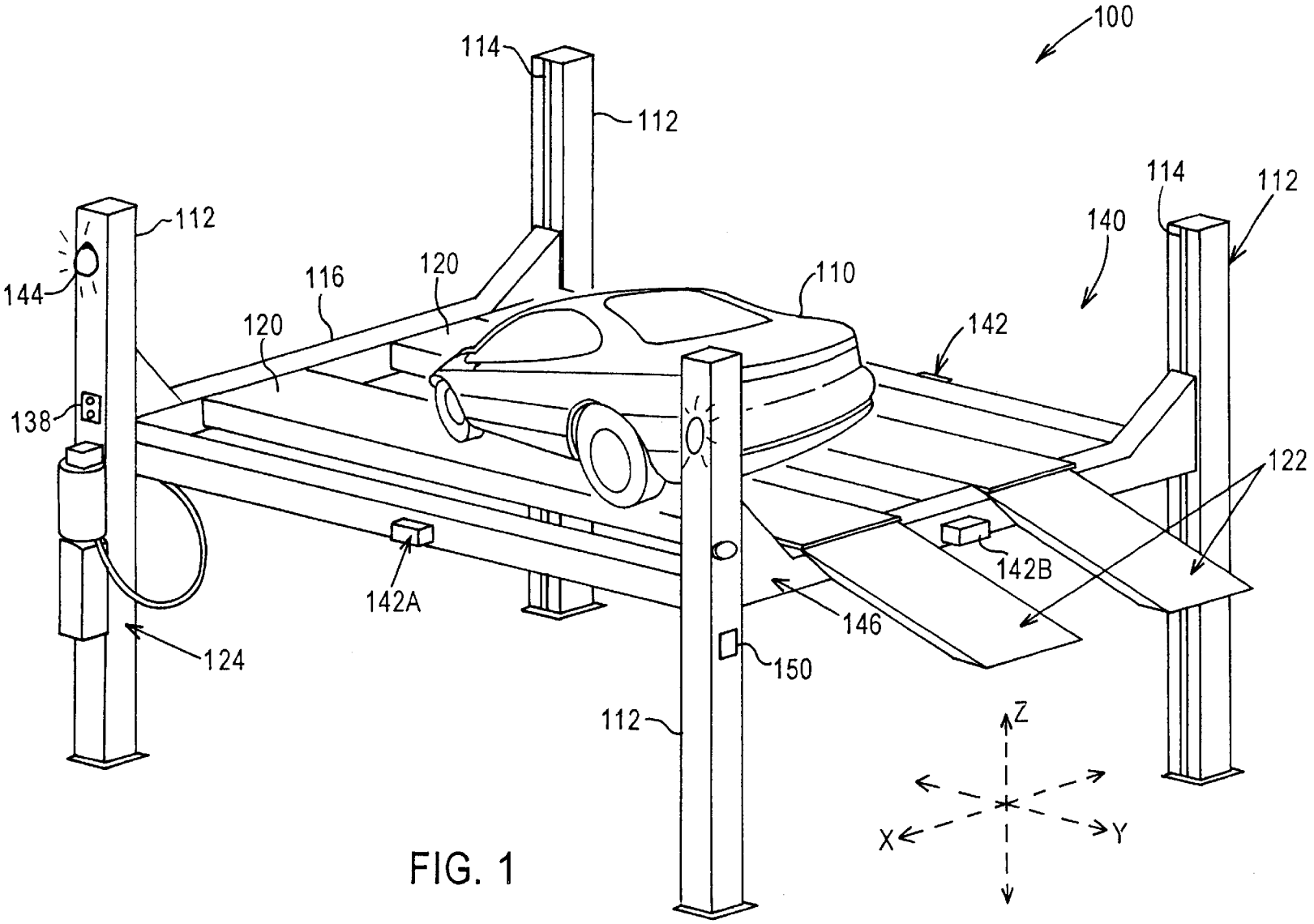
FIG. 1 is a perspective view of a lift assembly constructed in accordance with an embodiment of the present invention.

FIG. 1 is a perspective view of a lift assembly 100 constructed in accordance with an embodiment of the present invention. The lift assembly 100 is shown supporting a vehicle 110 in an elevated position. The lift assembly 100 includes a plurality of posts 112, a runway 116, a hoist system 124, a lift control circuit 136 (shown in FIG. 2), and a sensor arrangement 140. As illustrated in FIG. 1, the posts 112 are vertically oriented and disposed at predetermined locations to define a rectangular space. The locations of the posts 112 are carefully selected to allow various sized vehicles 110 to pass therebetween.

The runway 116 is slidably coupled to the posts 112 and allows a vehicle 110 placed thereon to be raised or lowered above the ground. The runway 116 includes a plurality of protrusions 118 (shown in FIG. 3)that extend into tracks 114 contained within the posts 112. The runway 116 also includes a pair of running boards 122 that support the tires of the vehicle 110. Further, as illustrated in FIG. 1, a pair of ramps 120 can be attached to the running boards 122 of the runway 116 in order to provide a gradual incline, thus allowing the vehicle 110 to be smoothly driven onto the runway 116.

The hoist system 124 supplies the force necessary to raise the runway 116, including the vehicle 110, to a prescribed height selected by a technician. The hoist system 124 includes all of the components (not shown) necessary to generate the force required to raise the runway 116, and can be either mechanical or hydraulically driven. Such components are well known and, accordingly, will not be described herein. According to the embodiment of the invention illustrated in FIG. 1, the hoist system 124 preferably is hydraulic.

Figure 2:
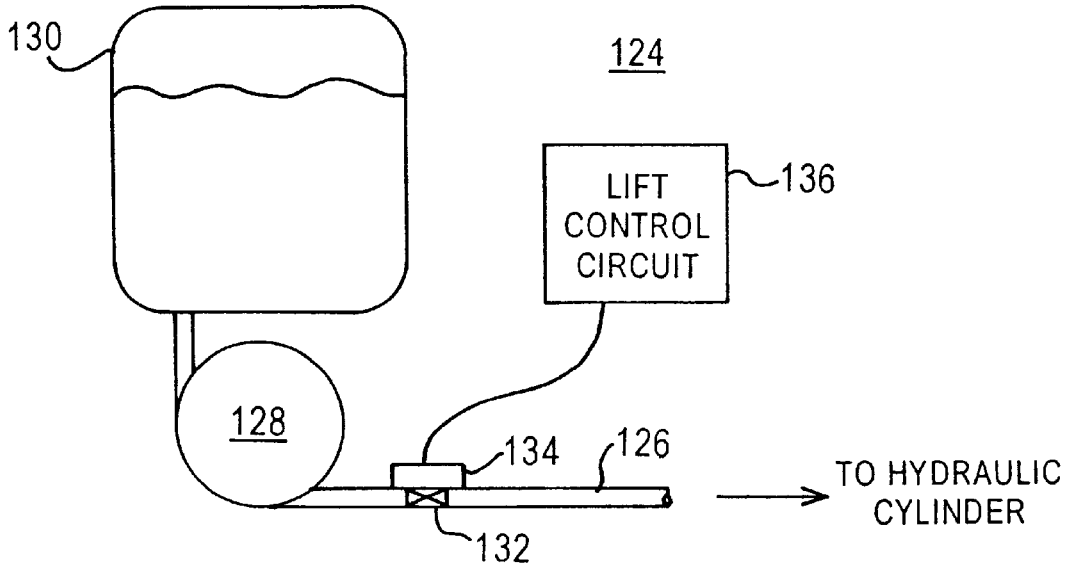
FIG. 2 is a partial cross-sectional view illustrating some of the components of an exemplary hoist system for use with the lift assembly shown FIG. 1.

FIG. 2 is a partial cross-sectional view illustrating some of the components of the exemplary hoist system 124. With continued reference to FIG. 1 and additional reference to FIG. 2, the hoist system 124 includes a pump 128 that forces fluid into hydraulic cylinders (not shown) within the posts 112. A fluid reservoir 130 is used to store the fluid used by the pump 128. Fluid forced into the cylinders reacts against a piston (not shown), and consequently causes the runway 116 to be raised. In order to lower the runway 116, a release port 132 is provided to allow fluid to return into the reservoir 130. According to the disclosed embodiment of the invention, a solenoid 134 is used to control operation of the release port 132. The solenoid 134 may, for example, be biased to maintain the release port 132 in a closed state, unless the pump 128 is operational. When placed in an open state, the release port 132 allows fluid to be drained from the hydraulic cylinders of the post 112, hence allowing the runway 116 to be lowered. Furthermore, the release port 132 is placed in the open state when the pump 128 is operational in order to allow passage of the pressurized fluid to raise the runway 116.

The lift control circuit 136 provides the signals and mechanical interconnections necessary to operate the hoist system 124 and selectively raise or lower the runway 116. For example, the lift control circuit 136 is operable by the technician to force hydraulic fluid into the cylinders of the posts 112, thereby raising the vehicle 110. When the vehicle 110 must be lowered, the lift control circuit 136 disengages the pump 128 that forces fluid into the cylinders of the posts 112, and energizes the solenoid 134 so that the release port 132 is placed in an open position. In the open position, the release port 132 allows fluid to be drained from the hydraulic cylinders of the posts 112, hence lowering the runway 116. The lift control circuit 136, other than as modified hereinafter, is of a type implemented in existing hydraulic lift assemblies.

Referring again to FIG. 1, the lift assembly 100 of the present invention includes a sensor arrangement 140 that incorporates a plurality of sensors 142. The sensors 142 are mounted on the runway 116 at prescribed locations in order to determine angular displacement about prescribed axes. For example, a first sensor 142A can be placed along a side of the runway 116 to detect rotation about an X-axis. Similarly, a second sensor 142B can be positioned to detect rotation of the runway 116 about the Y-axis. Together, the sensors 142 detect the degree of tilt of the runway's plane. According to one embodiment of the present invention, a third sensor 142C can be positioned on the opposite side of the runway 116. Such an arrangement has an advantage of detecting the degree of tilt of the runway 116 with greater accuracy.

As previously stated, the hoist system 124 according to the disclosed embodiment of the invention is hydraulically driven. The hoist system 124 forces hydraulic fluid from the reservoir 130 through a hydraulic line 126 and into the hydraulic cylinders (not shown) of the posts 112. Furthermore, the release port 132 can be selectively closed, or opened, in conjunction with operation of the pump 128, either to force hydraulic fluid into the hydraulic cylinders of the posts 112, or drain fluid from the hydraulic cylinders of the post 112 into the reservoir 130. These actions function, respectively, to raise and lower the runway 116. According to an alternative embodiment of the invention, a hoist system 124 can be coupled to each post 112. The pumps 128 can be operated using a single lift control switch in order to synchronously raise and lower the runway 116.

Operation of the hoist system 124 is controlled by the lift control circuit 136, which is operatively coupled to the pump 128 and the solenoid 134. The lift control circuit 136 includes a manually operated lift control switch 138 that allows the technician to raise or lower the runway 116. Further, the lift control circuit 136 synchronizes operation of the pump (or pumps) 128 and the solenoid 134 in response to the technician's desire to raise or lower the runway 116. The lift control circuit 136 is also coupled to the sensor arrangement 140. Hence, if the sensor arrangement 140 detects that the runway 116 has tilted to an unsafe orientation, an appropriate signal such as, for example, a tilt warning signal, is output to the lift control circuit 136 in order to suspend operation of the hoist system 124 until the situation is corrected.

According to the disclosed embodiment of the invention, the lift control circuit 136 can be coupled to an alarm system 144 that alerts the technician when the runway 116 has tilted to an unsafe orientation. The alarm system 144 can be in various configurations, as is well known in the art, so long as a sufficient warning is provided to the technician. For example, the alarm system can be in the form of a visual signal, such as a flashing light that alerts the technician to the unsafe orientation of the runway 116. Alternatively, the alarm system can be in the form of an audible signal, such as a siren, that alerts the technician to the orientation of the runway 116.

Figure 3:
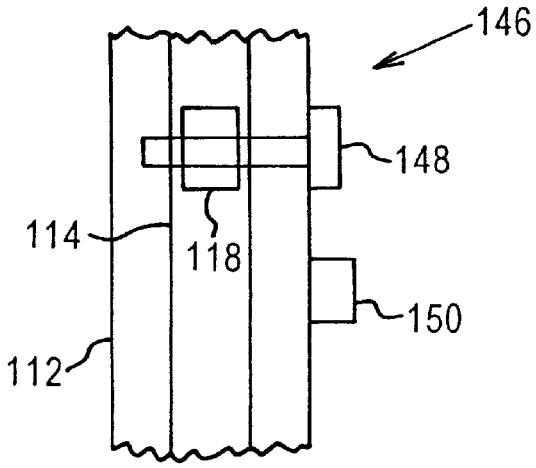
FIG. 3 is a partial cross-sectional view of an exemplary lock mechanism for use with the lift assembly of the present invention.

The lift assembly 100 of the present invention can also be provided with lock mechanisms 146 to secure the runway 116 once it has been raised, or lowered, to a desired height. Various types of lock mechanisms 146 are well known in the art for securing the runway of a lift assembly. FIG. 3 is a partial cross-sectional view of an exemplary lock mechanism 146 that can be used in conjunction with the lift assembly of the present invention. As illustrated, the lock mechanism 146 is in the form of a pin 148 that is insertable into an aperture contained in the runway 116. Each post 112 can be provided with corresponding apertures that receive the pin 148 at prescribed height intervals in order to secure the runway 116. According to such an embodiment, each post 112 includes an independent lock mechanism 146. The lock mechanism 146 can be secured by inserting the pin 148 into the aperture of its corresponding post 112 by the technician once a desired height has been obtained for the runway 116. Alternatively, the lock mechanism 146 can be configured for automatic operation such that upon activating a single lock switch 150 by the technician, a lock control circuit (not shown) causes all of the lock mechanisms 146 to engage their respective posts 112.

As previously stated, one of the most common situations that results in the runway 116 tilting to an unsafe orientation is when a technician inadvertently forgets to disengage one of the lock mechanisms 146. Hence, the use of a single lock switch 150 to simultaneously engage or disengage all of the lock mechanisms 146 has an advantage of reducing the probability that a technician will inadvertently leave one of the lock mechanisms 146 engaged while attempting to raise or lower the runway 116.

According to one embodiment of the present invention, the lift control circuit 136 can be further coupled to the lock switch 150. Upon being notified that the runway 116 has tilted to an unsafe orientation, the lift control circuit 136 can first suspend operation of the hoist system 124, and automatically attempt to level the runway 116. For example, if the runway 116 tilts while being raised, the lift control circuit 136 suspends operation of the runway 116 in the upward direction. Next, the lift control circuit 136 lowers the runway 116 while monitoring the tilt warning signal from the sensor arrangement 140. Once the lift control circuit 136 is notified by the sensor arrangement 140 that the runway 116 is level, the hoist system 124 shuts down. The lift control circuit 136 then attempts to disengage the lock mechanisms 146 by outputting an appropriate control signal to the lock switch 150. If the adverse orientation of the runway 116 was caused by failure of one of the lock mechanisms 146 to disengage, then the use of the lock switch 150 by the lift control circuit 136 will automatically disengage all of the lock mechanisms 146, thereby allowing the runway 116 to be safely raised by the operator.

Figure 4:
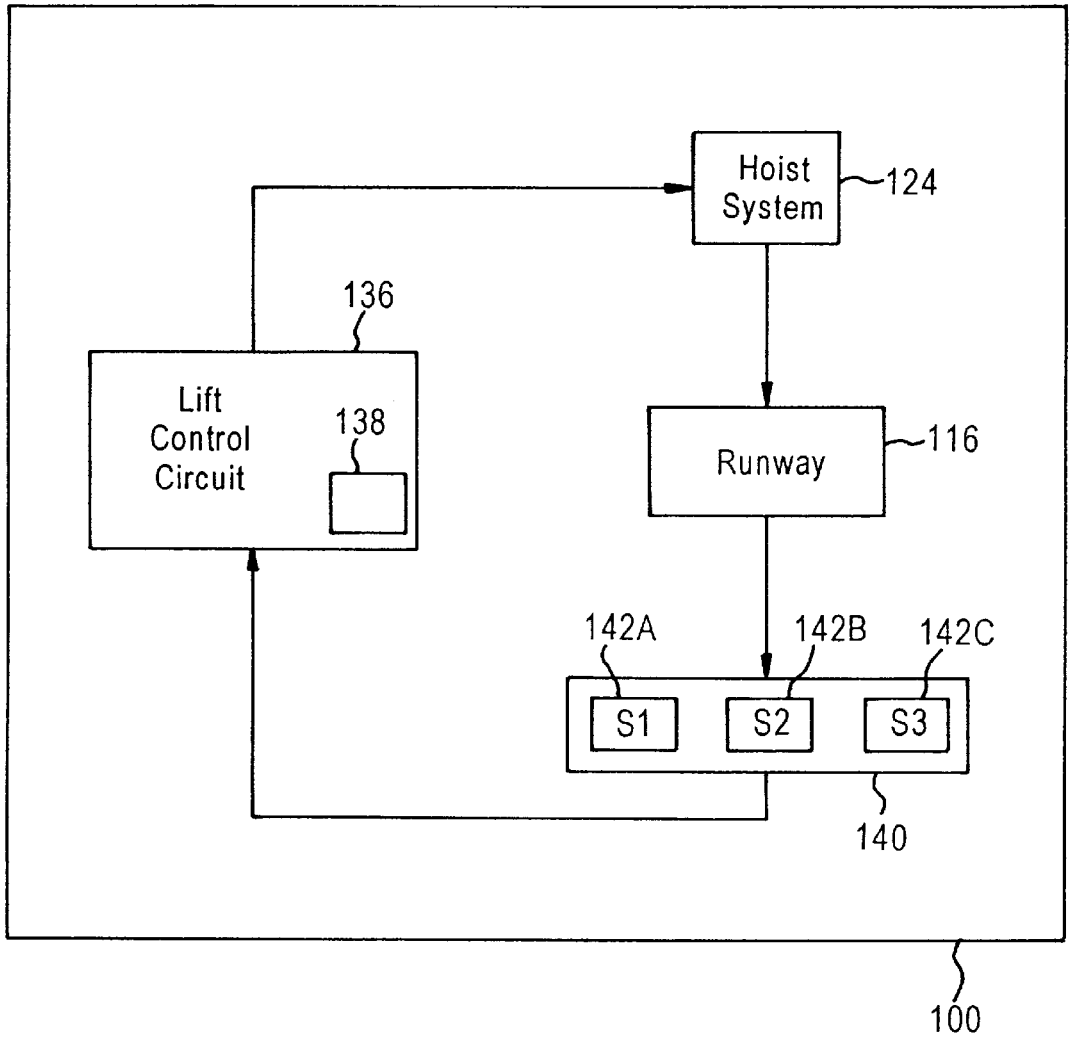
FIG. 4 is a block diagram illustrating an exemplary functional control block for the present lift assembly.

FIG. 4 is a block diagram illustrating an exemplary functional control block for use with the safety feature of the present lift assembly 100. As previously stated, a sensor arrangement 140 is coupled to the runway 116 to detect rotation about the X and Y axes. According to the preferred embodiment of the invention, the sensor arrangement 140 includes three individual sensors 142A, 142B, 142C strategically positioned to optimally detect excessive tilting of the runway 116. Further, the sensitivity of the sensor arrangement 140 can be programmed to output the tilt warning signal responsive to varying degrees of tilt by the runway 116. Specifically, the sensors 142 can be configured for variable sensitivity. Hence, by adjusting the sensitivity of the sensors 142, the technician can control the degree of tilt allowed by the runway 116 before the tilt warning signal is generated. Sensors having variable sensitivity (i.e., programmable) are well known, and thus not described in detail herein. The three sensors 142 can also, for example, be connected in series, such that detection of excessive tilt by any sensor will open the circuit and cause an interruption in the operation of the hoist system 124.

The lift control circuit 136 is operatively coupled to the sensor arrangement 140, and receives the tilt warning signal output by the sensor arrangement 140. The lift control circuit 136 also controls operation of the hoist system 124. Hence, the lift control circuit 136 controls the force required to raise or lower the runway 116 by, for example, by supplying power to the hoist system 124. During normal operation, the lift control circuit 136 can be configured to supply the necessary output signal for supply of power to the hoist system 124 if the runway 116 is maintained level. If the runway 116 tilts excessively, the sensor arrangement 140 will output the tilt warning signal. Upon receiving the tilt warning signal, the lift control circuit 136 will interrupt operation of the hoist system 124. The technician can then operate the hoist system 124 in the opposite direction until the sensor arrangement 140 terminates output of the tilt warning signal.

For example, if the runway 116 was being raised when it became tilted, then the lift control circuit 136 will allow the runway 116 only to be lowered. Alternatively, the lift control circuit 136 can be configured to temporarily interrupt operation of the hoist system 124 and alert the technician. Further, as previously stated, the lift control circuit 136 can be configured to operate an alarm system 144. Once operation of the hoist system 124 has been interrupted, the technician can inspect the lift assembly 100 to determine the cause of the malfunction.

According to one embodiment of the present invention, the lift control circuit 136 can be configured such that upon receiving a tilt warning signal from the sensor arrangement 140, only predetermined operations of the hoist system 124 are permitted. As illustrated in FIG. 4, such an embodiment requires that the lift control circuit 136 monitor signals output by the lift control switch 138 in order to determine the direction in which the runway 116 is travelling. For example, assume that the vehicle 110 is being raised. Upon detecting excessive tilting of the runway 116 relative to one or more of the prescribed axes, the sensor arrangement 140 will provide an appropriate indication of the runway's orientation to the lift control circuit 136 (i.e., in the form of the tilt warning signal). The lift control circuit 136 will then interrupt operation of the hoist system 124. Furthermore, the lift control circuit 136 will only allow the lift control switch 138 to lower the vehicle 110. For example, if the sensor arrangement 140 detects that the runway 116 has tilted to an unsafe orientation while the technician is raising the runway 116, then the lift control circuit 136 will suspend operation of the hoist system 124 in the upward direction. However, the lift control circuit 136 will allow the hoist system 124 to operate in the downward direction, thereby lowering the movable portions of the runway 116 until the runway 116 is again level. Alternatively, if the technician is in the process of lowering the lift assembly 100 and an unsafe orientation of the runway 116 occurs, then the lift control circuit 136 will suspend operation of the hoist system 124 in the downward direction. The lift control circuit 136 will allow the hoist system 124 only to raise the runway 116 until it has again reached a level orientation.

The present invention advantageously allows a technician to determine when a vehicle lift assembly has tilted to an unsafe orientation. The technician can then examine the lift assembly to determine the cause of the malfunction. One benefit of such an arrangement is the prevention of damage to the vehicle and/or harm to the technician.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A vehicle lift assembly comprising:

a plurality of vertically disposed posts;

a runway slidably coupled to said plurality of vertical posts and configured for receiving a vehicle thereon;

a hoist system for elevating said runway relative to said plurality of posts;

a sensor arrangement for detecting whether said runway tilts beyond a predetermined angular displacement, and producing an indication of the orientation of said runway; and a lift control circuit for receiving the indication produced by said sensor arrangement and controlling said hoist system to elevate said runway in a prescribed direction;

whereby the vehicle is prevented from inadvertently sliding off said runway.

2. The vehicle lift assembly of claim 1, further comprising an alarm system for alerting an operator of the orientation of said runway, and wherein said lift control circuit is configured to activate said alarm system to indicate that said runway has tilted beyond said predetermined angular displacement.

3. The vehicle lift assembly of claim 2, wherein said alarm system produces an audible alert.

4. The vehicle lift assembly of claim 2, wherein said alarm system produces a visual alert.

5. The vehicle lift assembly of claim 1, wherein the predetermined angular displacement detected by said sensor arrangement is programmable.

6. The vehicle lift assembly of claim 1, wherein said sensor arrangement includes at least two sensor units, and wherein a first sensor unit is configured to detect rotation of said runway about a first axis, and a second sensor unit is configured to detect rotation about a second axis perpendicular to said first axis.

7. The vehicle lift assembly of claim 1, further comprising at least one lock mechanism for securing said runway at a prescribed height.

8. The vehicle lift assembly of claim 1, wherein upon interrupted operation of said hoist system during travel in a prescribed direction, said lift control circuit, responsive to said sensor arrangement, allows operation of said hoist system in only a direction opposite to said prescribed direction.

9. The vehicle lift assembly of claim 1, wherein said hoist system is hydraulically driven.

10. A safety system for use with a vehicle lift assembly having a plurality of vertically disposed posts, a runway slidably coupled to the plurality of vertical posts for receiving the vehicle thereon, and a hoist system for elevating the runway relative to the plurality of posts, said safety system comprising:

a sensor arrangement for detecting whether the runway has tilted beyond a predetermined angular displacement, and producing an indication of the orientation of the runway; and a lift control circuit for receiving the indication produced by said sensor arrangement and controlling the hoist system to elevate the runway in a prescribed direction;

wherein upon receiving the indication produced by said sensor arrangement, said lift control circuit interrupts operation of the hoist system to prevent the vehicle from inadvertently sliding off the runway.

11. The safety system of claim 10, further comprising an alarm system for alerting an operator of the orientation of the runway, and wherein said lift control circuit is configured to activate said alarm system to indicate that the runway has tilted beyond said predetermined angular displacement.

12. The vehicle lift assembly of claim 10, wherein the predetermined angular displacement detected by said sensor arrangement is programmable.

13. The vehicle lift assembly of claim 10, wherein said sensor arrangement includes at least two sensor units, and wherein a first sensor unit is configured to detect rotation about a first axis, and a second sensor unit is configured to detect rotation about a second axis.

* * * * *